US010648277B2

(12) United States Patent
Stormo

(10) Patent No.: US 10,648,277 B2
(45) Date of Patent: May 12, 2020

(54) SUPPORTING DEVICE FOR A SEALING ELEMENT IN WELL PLUG

(71) Applicant: Interwell Technology AS, Ranheim (NO)

(72) Inventor: Terje Stormo, Trondheim (NO)

(73) Assignee: Interwell Technology AS, Ranheim (NO)

( * ) Notice: Subject to any disclaimer, the term of this patent is extended or adjusted under 35 U.S.C. 154(b) by 42 days.

(21) Appl. No.: 15/759,953

(22) PCT Filed: Sep. 7, 2016

(86) PCT No.: PCT/EP2016/071063

§ 371 (c)(1),
(2) Date: Mar. 14, 2018

(87) PCT Pub. No.: WO2017/045984

PCT Pub. Date: Mar. 23, 2017

(65) Prior Publication Data

US 2018/0245423 A1 Aug. 30, 2018

(30) Foreign Application Priority Data

Sep. 17, 2015 (NO) ..... 20151213

(51) Int. Cl.
*E21B 23/06* (2006.01)
*E21B 33/12* (2006.01)
(Continued)

(52) U.S. Cl.
CPC ..... *E21B 33/1293* (2013.01); *E21B 23/06* (2013.01); *E21B 33/128* (2013.01)

(58) Field of Classification Search
CPC ..... E21B 23/06; E21B 33/12; E21B 33/128; E21B 33/129
See application file for complete search history.

(56) References Cited

U.S. PATENT DOCUMENTS 2,767,794 A 10/1956 Lynes
6,318,461 B1 11/2001 Carisella
(Continued)

FOREIGN PATENT DOCUMENTS

GB 2 432 600 A 5/2007
WO 2012/164051 A2 12/2012
WO 2014/016408 A2 1/2014

OTHER PUBLICATIONS

International Search Report issued in PCT/EP2016/071063 dated Nov. 22, 2016 (5 pages).
(Continued)

*Primary Examiner* — Cathleen R Hutchins
(74) *Attorney, Agent, or Firm* — Osha Liang LLP

(57) ABSTRACT

A sealing device for a well plug includes a mandrel device, a sealing element, a first supporting device provided on a first side of the sealing element and a second supporting device provided on a second side of the sealing element. Each supporting device includes proximal supporting elements provided proximal to the sealing element and distal supporting elements, where first ends of the respective proximal and distal supporting elements are pivotably connected to each other. The second ends of the proximal supporting elements are pivotably connected to a connector of a proximal supporting ring. The sealing device is brought from a run state to a first set state by relative axial movement of the distal supporting rings towards each other and relative axial movement of the proximal supporting rings towards each other.

10 Claims, 8 Drawing Sheets

(51) Int. Cl.
*E21B 33/128* (2006.01)
*E21B 33/129* (2006.01)

(56) References Cited

U.S. PATENT DOCUMENTS

| | | | | |
|---|---|---|---|---|
| 7,178,602 | B2 | 2/2007 | Hiorth et al. | |
| 2004/0194969 | A1* | 10/2004 | Hiorth | E21B 33/1216 166/382 |
| 2011/0073310 | A1* | 3/2011 | Clemens | E21B 23/01 166/285 |
| 2011/0073329 | A1 | 3/2011 | Clemens et al. | |
| 2012/0217025 | A1 | 8/2012 | Shkurti et al. | |
| 2013/0333875 | A1 | 12/2013 | Hiorth et al. | |
| 2015/0075774 | A1 | 3/2015 | Raggio | |

OTHER PUBLICATIONS

Written Opinion of the International Searching Authority issued in PCT/EP2016/071063 dated Nov. 22, 2016 (5 pages).
Norwegian Search Report issued in NO 20151213 dated Apr. 16, 2016 (2 pages).

* cited by examiner

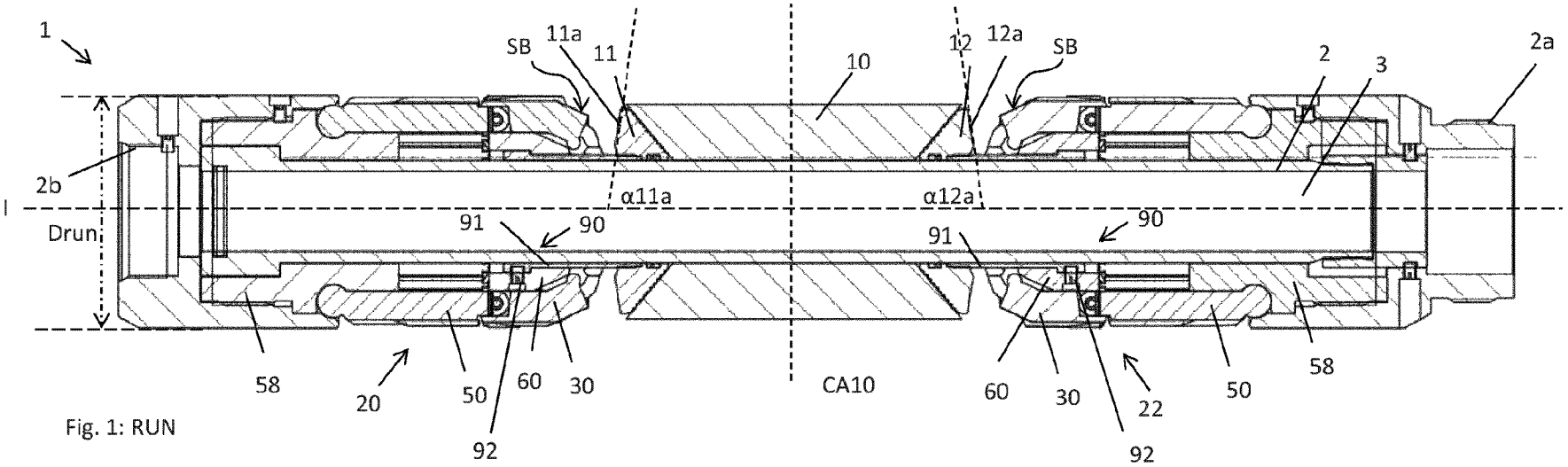
Fig. 1: RUN
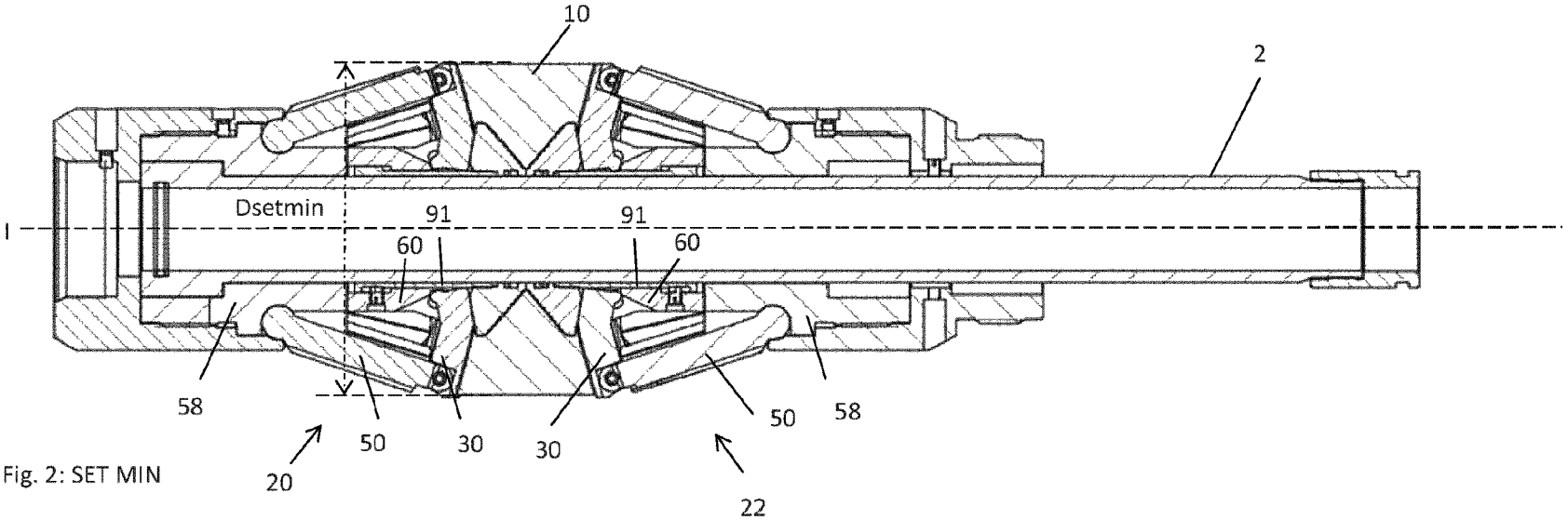
Fig. 2: SET MIN

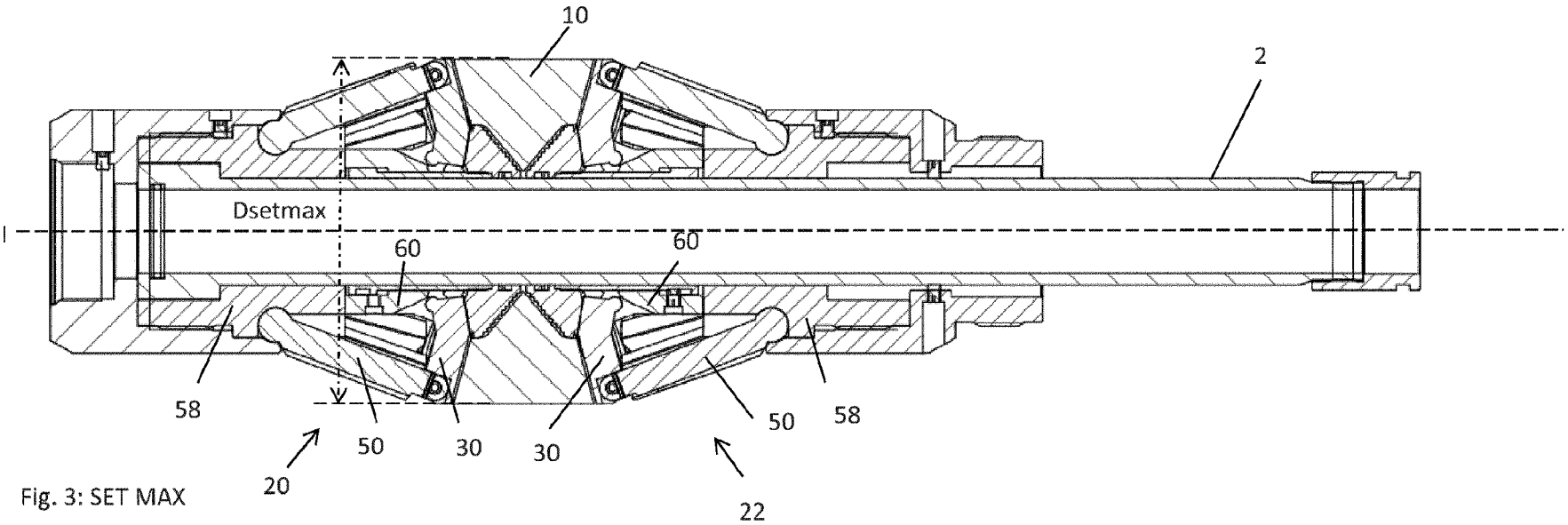
Fig. 3: SET MAX

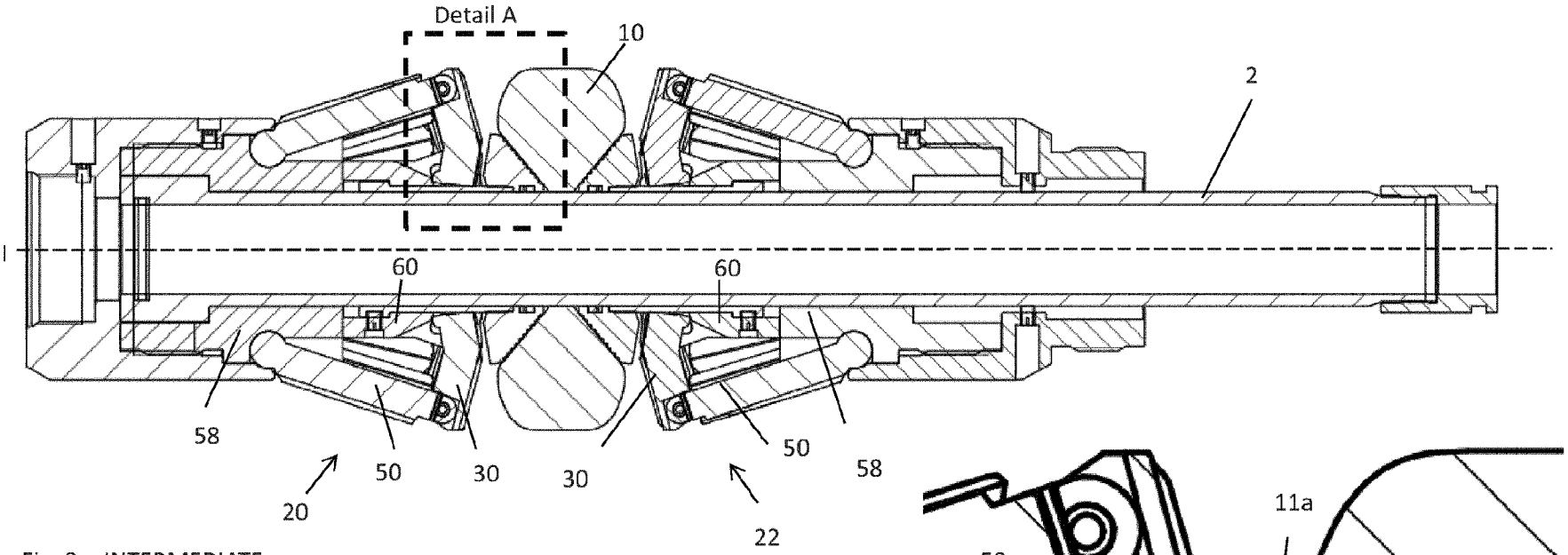
Fig. 9a: INTERMEDIATE
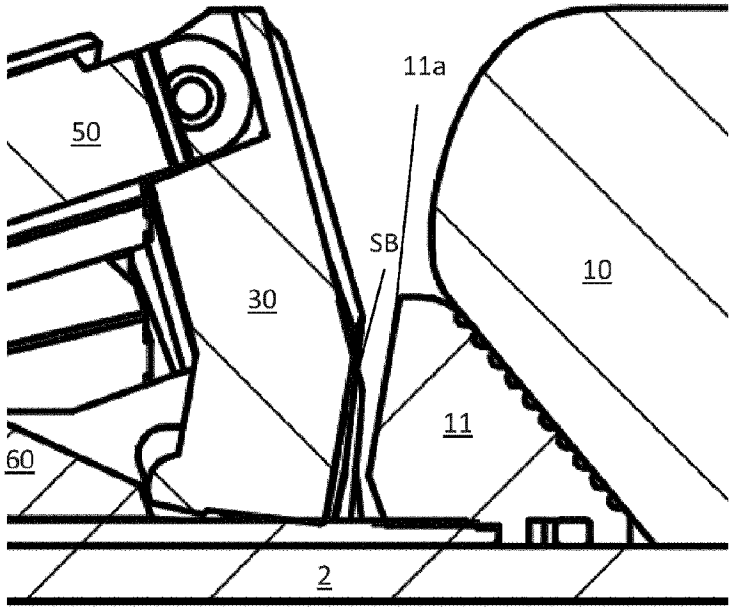
Fig. 9b

SUPPORTING DEVICE FOR A SEALING ELEMENT IN WELL PLUG

FIELD OF THE INVENTION

The present invention relates to a supporting device for a sealing element in a well plug.

BACKGROUND OF THE INVENTION

Many well tools, such as well plugs (bridge plugs, packers, etc.) comprise a sealing device and an anchor device connected to a mandrel. The plug has a radially retracted, or run, state and a radially expanded, or set, state. In the set state, the anchoring device is in contact with the inner surface of the well pipe, and prevents the plugging device from moving axially within the well pipe. In the set state, the sealing device is sealing off the annular space between the mandrel of the plug and the inner surface of the well pipe in order to prevent fluid flow between the lower side of the sealing element and the upper side of the sealing element.

The sealing device comprises a sealing element designed to retract and expand between its run and set states and must also be designed to withstand a high pressure difference and also to be able to seal the annular area at high temperatures. In order to do so, the sealing element, typically made from an elastomer, a rubber material etc., must be supported by supporting devices in the set state.

One such plug is shown in U.S. Pat. No. 7,178,602. Here, the sealing device comprises a sealing element and supporting devices on its upper and lower sides. Each supporting device comprises a number of first supporting arms and a number of second supporting arms having their first ends pivotably connected to a supporting ring provided around the mandrel and where their second ends are pivotably connected to each other. This principle is used in the commercially available High Expansion Retrievable Bridge plug (HEX plug), sold and marketed by Interwell (http://www.interwell.com/hex-retrievable-bridge-plug/category178.html).

One of the HEX plugs is made for use in a 7" 29 pounds/feet well pipe, where the specification for such pipes allows the inner diameter of the pipe to vary in a range between ca 154.6-159.8 mm, i.e. a variation in the distance between the outside of the supporting arms of the plug in its set state to the inner surface of the well pipe up to 3 mm. The supporting devices can not be made to expand to the largest possible diameters of these pipes, because then, when set in a narrower pipe (i.e. close to 154.6 mm), the supporting devices will contact the pipe surface before a sufficient compression of the sealing element has been achieved.

The HEX is tested and approved for a differential pressure of 4000 psi at a temperature T=110° C. according to ISO 14310:2008 up to validation grade V0.

At higher temperatures and/or higher pressures, the material of the sealing element may be extruded into the gap between the supporting devices and the inner surface of the well pipe in particular if the plug is set in an well pipe having a large inner diameter (i.e. close to 159.9 mm).

One common way to reduce the extrusion of the sealing element is to incorporate a supporting ring within the sealing element itself, such as shown in FIG. 6*a-c* of WO 2014/016408 and in WO 2012/164051.

One or more embodiments of the present invention may provide a sealing device which can be used to seal well pipes at higher pressures and/or higher temperatures than the above sealing device. In particular, is to one or more embodiments may provide a sealing device which can be used to seal well pipes having a varying inner diameter and to provide a sealing device where the extrusion of the sealing element is reduced and/or prevented in such well pipes.

SUMMARY

One or more embodiments of the present invention may relate to a sealing device for a well plug, comprising:

a mandrel device;

a sealing element provided circumferentially around the mandrel device;

a first supporting device provided on a first side of the sealing element;

a second supporting device provided on a second side of the sealing element;

where each supporting device comprises proximal supporting elements provided proximal to the sealing element and distal supporting elements, where first ends of the respective proximal and distal supporting elements are pivotably connected to each other;

where second ends of the proximal supporting elements are pivotably connected to a connector of a proximal supporting ring;

where second ends of the distal supporting elements are connected to a distal supporting ring;

where the sealing device is configured to be brought from a run state to a first set state by relative axial movement of the distal supporting rings towards each other and relative axial movement of the proximal supporting rings towards each other;

characterized in that the connector comprises an expansion section in the radial direction of the proximal supporting ring, the expansion section allowing the proximal supporting element to be displaced at a radial distance from the first set state to a second set state.

Accordingly, if there is available space radially outside of the supporting devices in the first set state, the proximal supporting element may expand further radially outwards, and may occupy this available space. Hence, the available space for the sealing element to be extruded is considerably reduced.

According to one aspect of the invention, the connector of the proximal supporting ring comprises a slit and a curved recess and where the expansion section is being provided as a radial expansion of the curved recess.

According to another aspect of the invention, the second end of the proximal supporting element comprises a spherical-like connector, where the spherical-like connector, the curved recess and the expansion section of the connector are adapted to each other.

According to one aspect of the invention, the sealing device further comprises a delay mechanism for each supporting device, where the delay mechanism is configured to delay the radial expansion of the supporting devices in relation to the radial expansion of the sealing element when moving from the run state to the set state.

According to one aspect of the invention, the delay mechanism comprises an axially displaceable sealing element setting sleeve provided radially between the proximal supporting ring and the mandrel device, a shear pin connecting the proximal supporting ring to the axially displaceable sealing element setting sleeve in the run state.

According to one aspect of the invention, the sealing device further comprises a first cone ring provided around the mandrel device axially between the first supporting device and the sealing element and a second cone ring provided around the mandrel device axially between the second supporting device and the sealing element, where the first and second cone rings each comprise an abutment surface in abutment with a front expansion surface of the respective proximal supporting elements in the first set state and in the second set state.

According to one aspect of the invention, the first abutment surface has an angle α11*a* in relation to the longitudinal direction of the sealing device and the second abutment surface has an angle α12*a* in relation to the longitudinal direction of 30-90°.

According to one aspect of the invention, each of the proximal supporting elements comprises a rear expansion surface provided on the opposite side of the front expansion surface, where the angle $\alpha_{exp}$ between the front and rear expansion surfaces is between 20-60°.

According to one aspect of the invention, where the rear expansion surface is oriented perpendicular to the longitudinal axis of the distal supporting element.

According to one aspect of the invention, where an axial compression force is used for bringing the sealing device from the run state to the set state is transferred from the distal supporting rings to the proximal supporting rings.

DETAILED DESCRIPTION

In the following, embodiments of the present invention will be described in detail with reference to the enclosed drawings, where:

FIG. 1 illustrates a cross sectional side view of the well tool device in its run state FIG. 2 illustrates the well tool device of FIG. 1 in a first set state;

FIG. 3 illustrates the well tool device of FIG. 1 in a second set state;

Figure 4B:
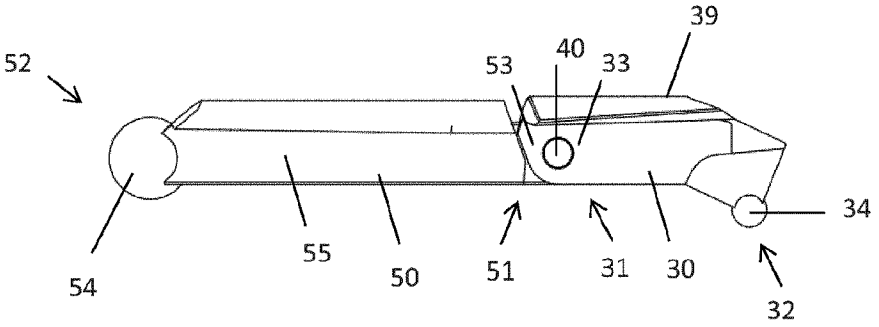
Figure 4C:
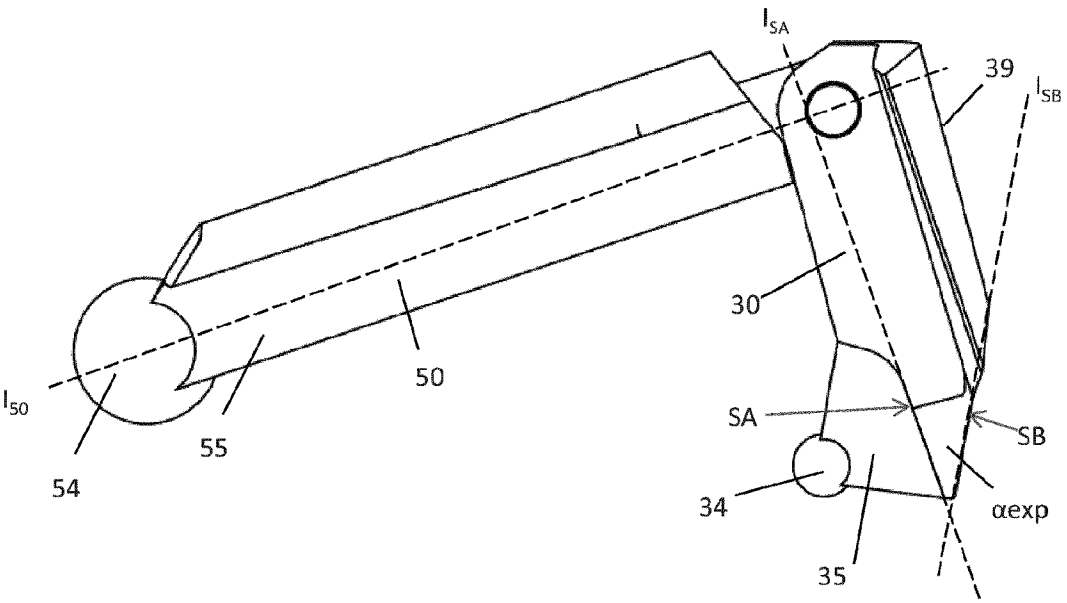
Figure 4A:
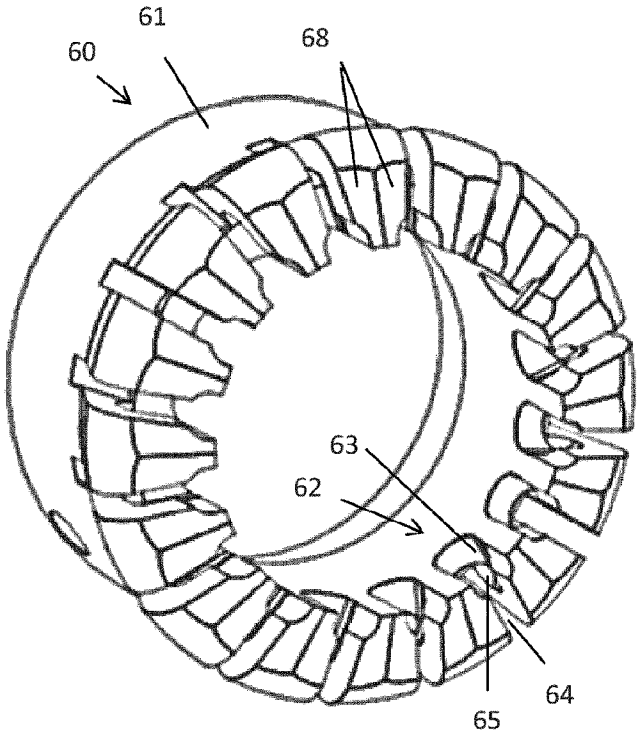
Figure 5B:
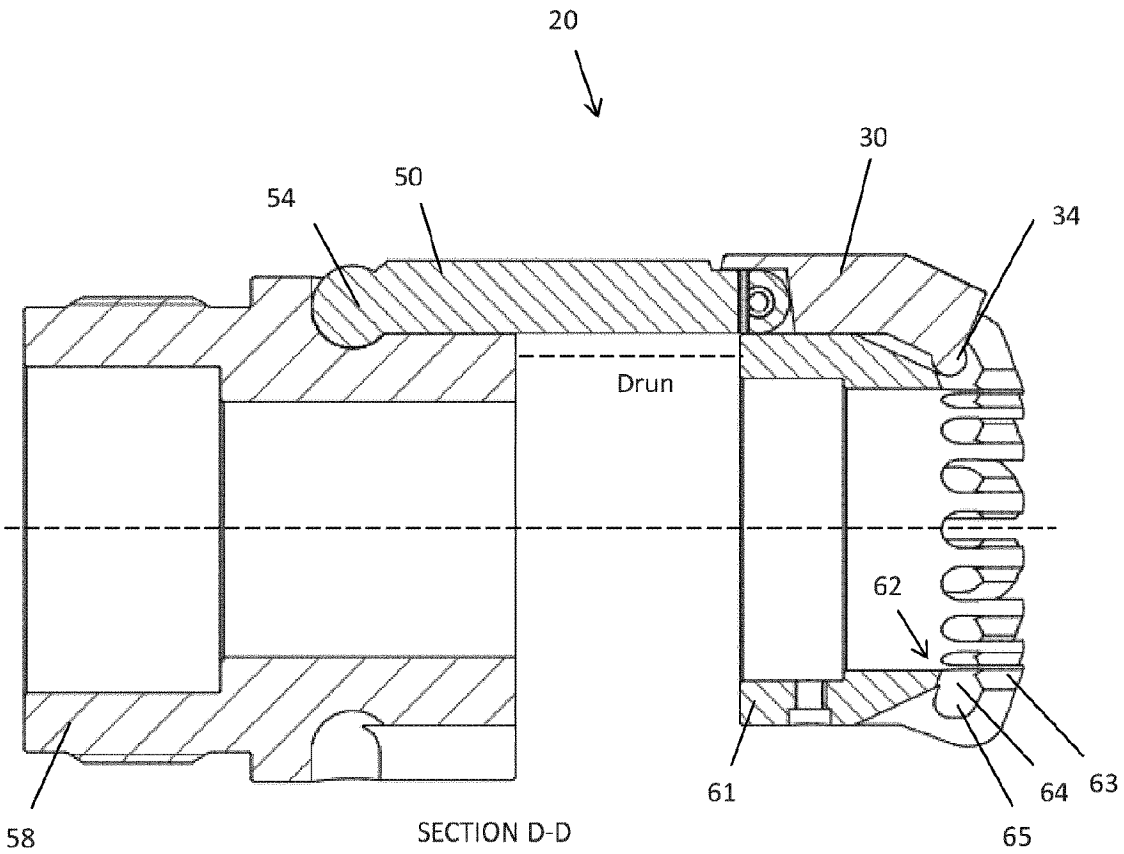
Figure 5A:
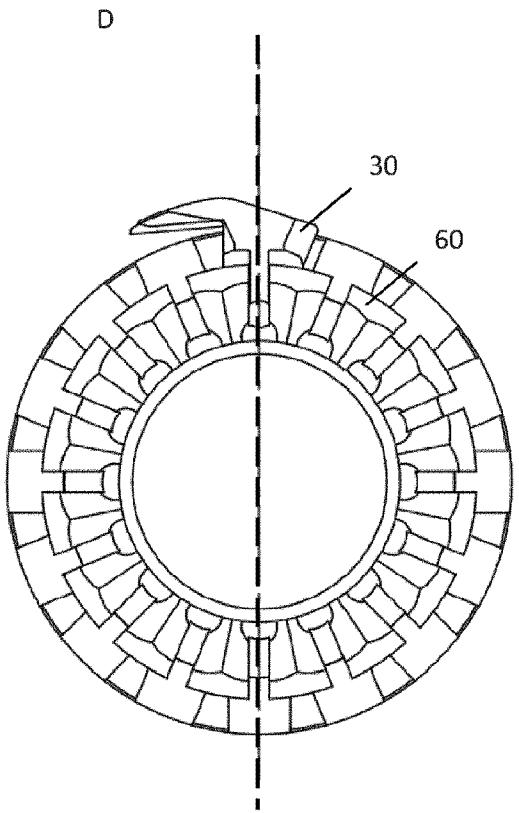

FIG. 4*a* illustrates a supporting ring;

FIG. 4*b* illustrates a proximal and distal supporting element in the run state;

FIG. 4*c* illustrates the proximal and distal supporting element in the set state;

FIG. 5*a* illustrates a front cross sectional view of the supporting ring with one proximal supporting element in the run state;

FIG. 5*b* illustrates the cross section D of FIG. 5*a;*

Figure 6B:
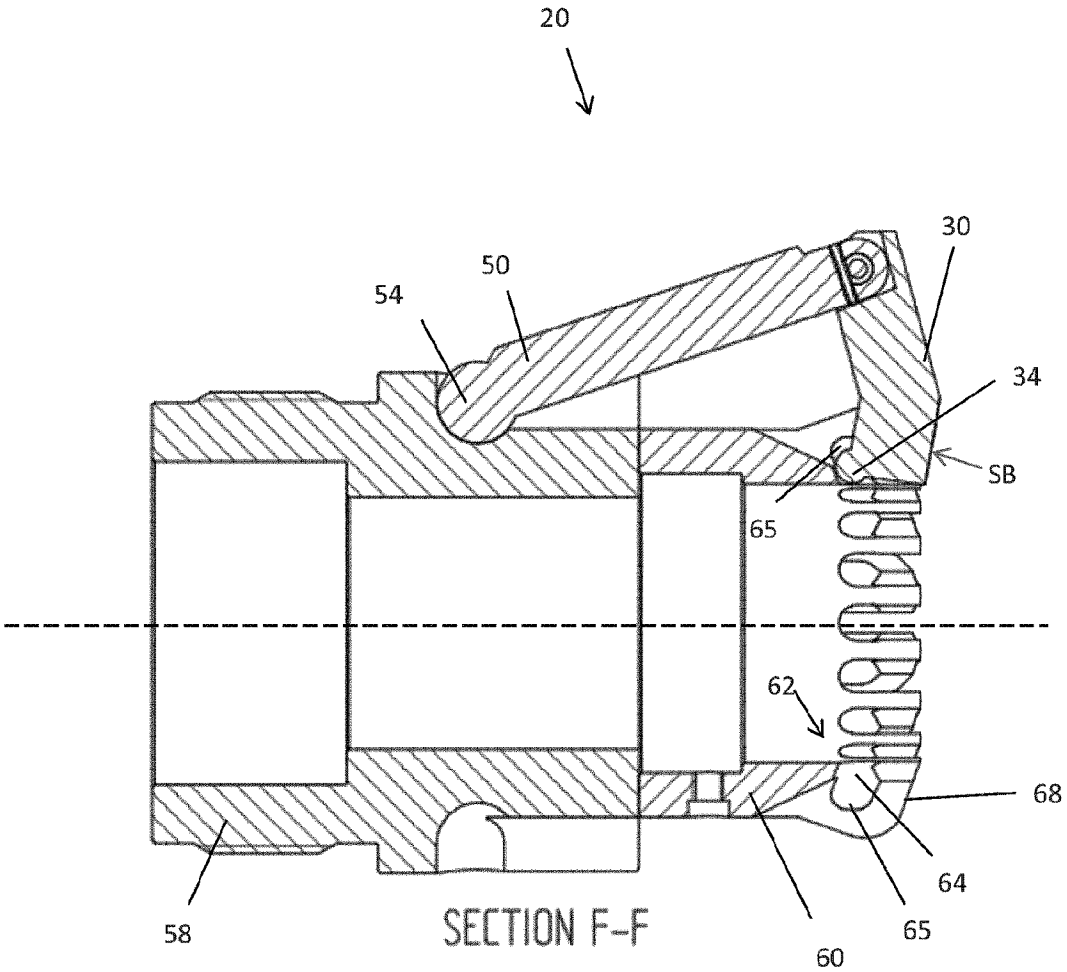
Figure 6A:
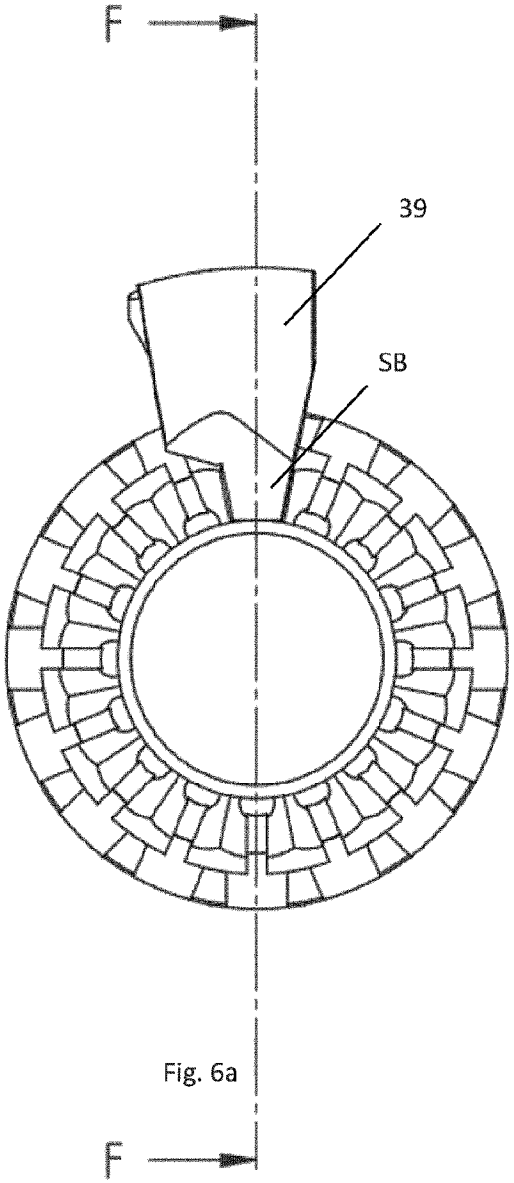

FIG. 6*a* illustrates a front cross sectional view of the supporting ring with one proximal supporting element in the first set state;

FIG. 6*b* illustrates the cross section F of FIG. 6*a;*

Figure 7B:
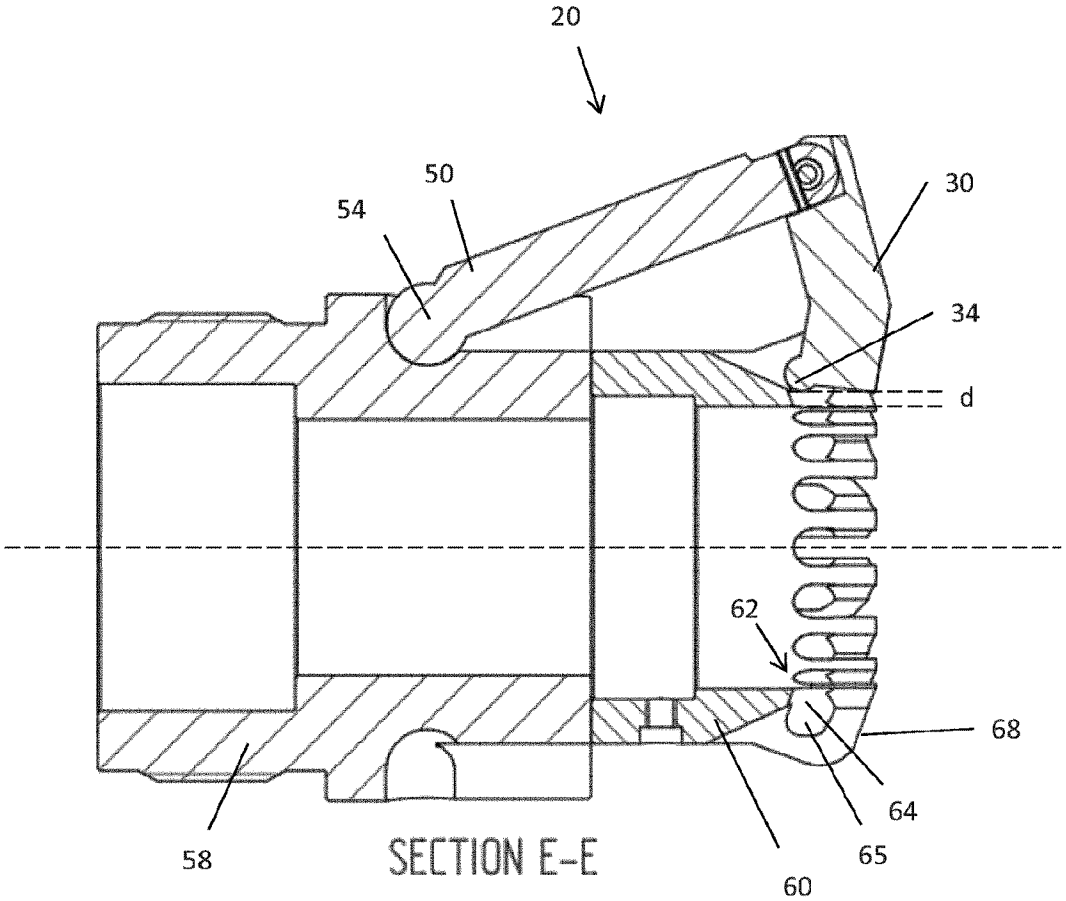
Figure 7A:
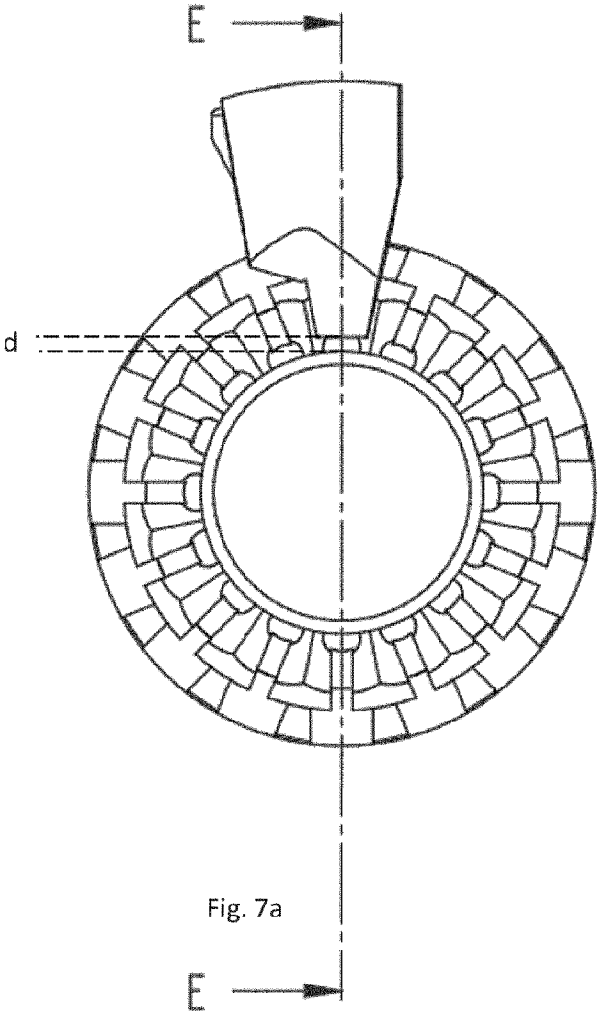

FIG. 7*a* illustrates a front cross sectional view of the supporting ring with one proximal supporting element in the second set state;

FIG. 7*b* illustrates the cross section E of FIG. 7*a;*

Figure 8B:
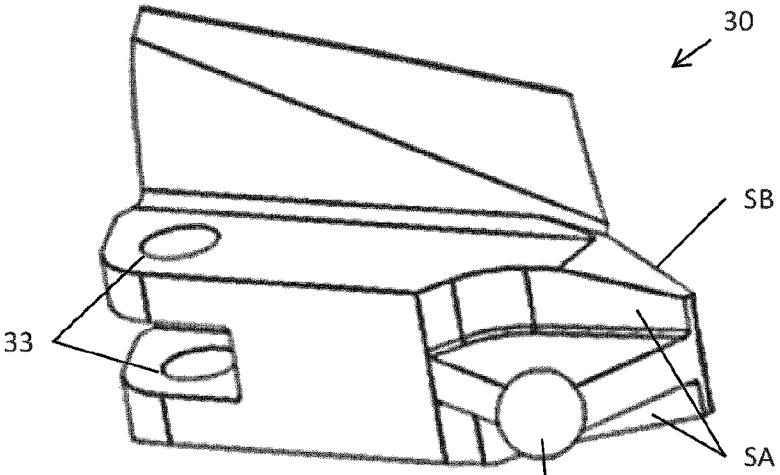
Figure 8A:
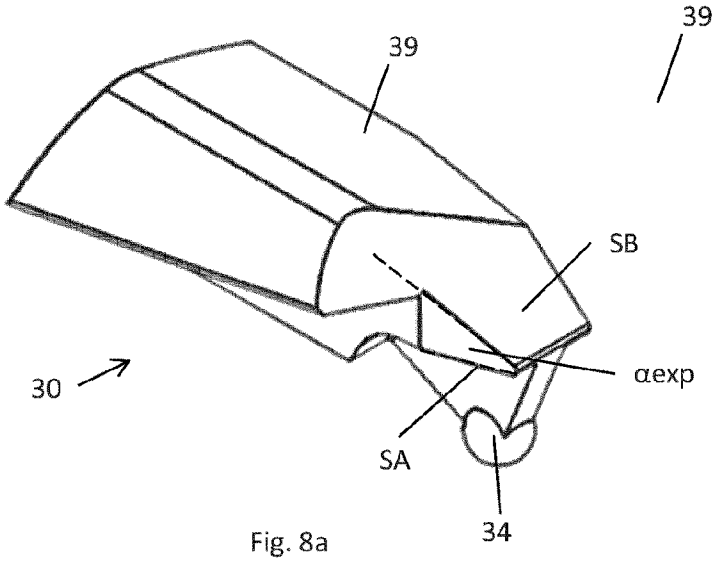
Figure 8C:
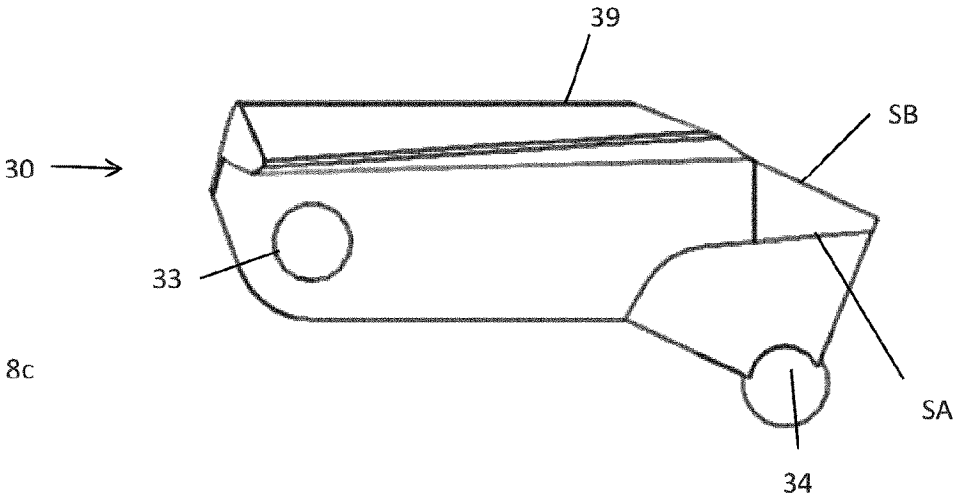

FIGS. 8*a*, 8*b* and 8*c* illustrate different perspective views of the proximal supporting element;

FIG. 9*a* illustrates a cross sectional side view of the well tool device in its intermediate state, between the run state and the set state;

FIG. 9*b* illustrates an enlarged view of detail A in FIG. 9*a*.

It is now referred to FIG. 1, where a sealing device 1 is shown. The sealing device 1 may for example be used as a part of a well plug, such as a bridge plug, a packer, etc, where the well plug itself comprises further elements such as a connection interface to a setting tool, anchoring devices for anchoring the well plug to the inner surface of the well pipe to prevent axial movement of the well plug in relation to the well pipe, etc. Such further elements are considered known for a skilled person, and will not be described herein in detail.

As shown in FIG. 1, the sealing device 1 comprises a mandrel device 2. A sealing element 10 is provided circumferentially around the mandrel device 2. The sealing element 10 is typically made of a flexible material such as a rubber material, an elastomeric material etc, where the purpose of the sealing element 10 is to provide a fluid seal when in contact with the mandrel device 2 and the inner surface of the well pipe.

A first supporting device 20 provided on a first side of the sealing element 10 and a second supporting device 22 provided on a second side of the sealing element 10. Each of these supporting devices 20, 22 comprises a proximal supporting element 30 provided proximal to the sealing element 10 and a distal supporting element 50 provided distal to the sealing element 10, i.e. the proximal supporting element 30 is closer to the sealing element 10 than the distal supporting element 50.

The first ends 31, 51 of the respective proximal and distal supporting elements 30, 50 are pivotably connected to each other. More specifically, the first end 31 of the proximal supporting element 30 of the first supporting device 20 is pivotably connected to the first end 51 of the distal supporting element 50 of the first supporting device 20, while the first end 31 of the proximal supporting element 30 of the second supporting device 22 is pivotably connected to the first end 51 of the distal supporting element 50 of the second supporting device 22. In FIG. 4*b*, and in FIG. 8*b*, it is shown that the first end 31 of the proximal supporting element 30 comprises connection interfaces 33 for connection to a connection interface 53 of the first end 51 of the distal supporting element 50, where a bolt 40 (FIGS. 4*b* and 4*c*) are used to connect the connection interfaces 33, 53 to each other while allowing movement between the positions shown in FIGS. 4*b* and 4*c*.

In FIGS. 4*b* and 4*c* it is shown that the second end 32 of the proximal supporting element 30 comprises a substantially sphere-like body 34 fixed to a plate-like structure 35. The second end 32 of the proximal supporting element 30 is pivotably connected to a connector 62 of a proximal supporting ring 60.

The connector 62 of the proximal supporting ring 60 comprises a slit 63 and a curved recess 64, adapted to receive the sphere-like body 34 and the plate-like structure 35. The plate-like structure 35 is allowed to move within the slit 63 and the sphere-like body 34 is allowed to pivot within the curved recess 64.

In FIGS. 4*b* and 4*c* it is also shown that the second end 52 of the distal supporting element 50 comprises a substantially sphere-like body 54 fixed to a plate-like structure 55. The second end 52 of the distal supporting element 50 is connected to a distal supporting ring 58, in similar way as the proximal supporting ring 60 and the second end 32 of the proximal supporting element 30.

The above description, in particular the description of the distal supporting ring 58, the distal supporting element 50 and the proximal supporting element 30 are similar or even identical to the present, prior art HEX plug.

As shown in FIGS. 1 and 2 the sealing device 1 is configured to be brought from a run state to a first set state by relative axial movement of the distal supporting rings 58 towards each other and relative axial movement of the proximal supporting rings 60 towards each other. In FIG. 5*b* and FIG. 6*b*, it is shown more clearly that in the run state (FIG. 5*b*), there is a distance Drun between the proximal and distal supporting rings 58, 60, while in the first set state (FIG. 6*b*), the proximal and distal supporting rings 58, 60 has been displaced axially towards each other and are in contact with each other. It should be noted that this contact in the first state is not strictly necessary, it would for example be possible to provide an intermediate member axially between these supporting rings.

It is now referred to FIG. 4*a*, FIG. 5*b* and FIG. 6*b*. Here, it is shown that the connector 62 comprises an expansion section 65 in the radial direction of the proximal supporting ring 60. In the one or more embodiments, the expansion section 65 is provided as a radial expansion of the curved recess 64 itself.

The expansion section 65 is allowing the proximal supporting element 60 to be displaced at a radial distance d from the first set state to a second set state. The second set state is illustrated in FIG. 3, FIG. 7*a*, and FIG. 7*b*. The distance d in FIGS. 7*a* and 7*b* is equal to the half of the difference between the diameter in the second set state Dsetmax (indicated in FIG. 3) and the diameter in the first set state Dsetmin (indicated in FIG. 2), i.e.:

$$d = \frac{Dsetmax - Dsetmin}{2}$$

The spherical-like connector 34 of the second end 32 of the proximal supporting element 30, the curved recess 64 and the expansion section 65 of the connector 62 are adapted to each other to allow the movement between the run state, the first set state and the second set state. The sealing device 1 comprises a first cone ring 11 provided around the mandrel device 2 axially between the first supporting device 20 and the sealing element 10 and a second cone ring 12 provided around the mandrel device 2 axially between the second supporting device 22 and the sealing element 10, as shown in FIG. 1. The cone rings 11, 12 are axially displaceable in relation to the mandrel device 2, and one of their purposes is to contribute to the axial compression and hence the radial expansion of the sealing element 10.

The first and second cone rings 11, 12 each comprise an abutment surface 11*a*, 12*a* as shown in FIG. 1. The first abutment surface 11*a* is facing the proximal supporting element 30 of the first supporting device 20 and has an angle α11*a* in relation to the longitudinal direction I of the sealing device 1. The second abutment surface 12*a* is facing the proximal supporting element 30 of the second supporting device 22 and has an angle α12*a* in relation to the longitudinal direction I. As shown in FIG. 1, both angles α11*a*, α12*a* are directed towards the radial center axis CA10 of the sealing element 10.

In the one or more embodiments, the angles α11*a*, α12*a* are between 30-90°, more preferably possibly for example between 60-80°. In the embodiment shown in FIG. 1 these angles are 80°.

The abutment surfaces 11*a*, 12*a* are in abutment with a front expansion surface SB of the respective proximal supporting elements 30 in the first set state and in the second set state.

Each of the proximal supporting elements 30 also comprises a rear expansion surface SA, as indicated in FIGS. 8*a*, 8*b* and 8*c*. The rear expansion surface SA is provided on the opposite side of the front expansion surface SB, as indicated in FIG. 8*a*. The angle $\alpha_{exp}$ between the front and rear expansion surfaces SA, SB is preferably may be between 10-60°, possibly between 20-40°. In the embodiment shown in the drawings, the angle $\alpha_{exp}$ is 30°.

The rear expansion surface SA is supported against a corresponding surface 68 (see FIGS. 4*a*, 6*b* and 7*b*) of the proximal supporting ring 60 in the first and second set states.

In the embodiment shown in FIG. 4*c*, the rear expansion surface SA of the proximal supporting element 30 is oriented substantially perpendicular, such as with an angle between 85-95°, to the longitudinal axis $I_{50}$ of the distal supporting element 50 in the first set state. In FIG. 4*c*, a line Isa is indicating the plane of the rear expansion surface SA, where the line Isa is continued further to cross the longitudinal axis I50. In FIG. 4*c*, a line $I_{SA}$ is shown to continue in parallel with the longitudinal axis of the proximal supporting element 30 and crosses the longitudinal axis $I_{50}$ at an angle about 90°. In FIG. 4*c*, the above described angle $\alpha_{exp}$ is shown between lines $I_{SA}$ and $I_{SB}$.

The angle between the lines ISA and I50 may about 90° also in the second set state. Accordingly, the rear expansion surfaces SA will be in contact with the surface 68 of the respective proximal supporting ring 60 and the front expansion surfaces SB will be in contact with the respective first and second abutment surface 11*a*, 12*a* both in the first and second set states.

Consequently, due to the angle between the rear expansion surface SA and the front expansion surface SB and these surfaces SA, SB being pressed between surfaces 11*a* (or 12*a*) and 68, the proximal supporting elements 30 will be pressed outwardly.

In one or more embodiments, the sealing device 1 comprises a delay mechanism 90 for each supporting device 20, 22. The delay mechanism 90 is configured to delay the radial expansion of the supporting devices 20, 22 in relation to the radial expansion of the sealing element 10 when moving from the run state to the set state.

In one or more embodiments, the delay mechanism 90 comprises an axially displaceable sealing element setting sleeve 91 provided radially between the proximal supporting ring 60 and the mandrel device 2 and a shear pin 92 connecting the proximal supporting ring 60 to the axially displaceable sealing element setting sleeve 91 in the run state.

Accordingly, when the setting operation is initiated from the run state, the proximal supporting ring 60 of the first supporting device 20 and the proximal supporting ring 60 of the second supporting device 22 will be displaced towards each other, while the proximal supporting elements 30 of both the first and second supporting devices 20, 22 will be prevented from a full radial expansion by the delay mechanism 90.

This state is shown in FIGS. 9*a* and 9*b*, and is referred to as an intermediate state between the run state and the first set state. As shown, the supporting devices 20, 22 and the sealing element 10 have been radially expanded, but as shown in FIG. 9*b*, there is no contact between the front expansion surface SB and the abutment surface 11*a* (and correspondingly for the abutment surface 12*a*).

When the axial force applied to the distal supporting ring(s) 58 is above a threshold value, then the shear pin 92 will shear off, and then also the pivotal and distal supporting elements 30, 50 is allowed to expand fully to the first set state shown in FIG. 2.

In FIGS. 6*b* and 7*b*, it is disclosed that the distal and proximal supporting rings 58, 60 are in contact with each other in the first set state and in the second set state. In an alternative embodiment, a further sleeve (not shown) can be provided between the distal and proximal supporting rings.

Axial force will still be transferred from the distal supporting ring to the proximal supporting ring.

By this further radial expansion from the first set state to the second set state, it is achieved that the proximal supporting elements 30 on each side of the sealing element 10 to a larger extent than with the previous HEX plug will prevent extrusion of the sealing element 10 if the sealing device 1 is set in well pipes with a slightly larger diameter (for example 159.8). In well pipes with a slightly smaller diameter (for example ca 154.6 mm), the proximal supporting elements 30 will expand until they come into contact with the inner surface of the well pipe. Also here, extrusion of the sealing element 10 is prevented.

A prototype of a plug with the sealing device shown in FIGS. 1, 2 and 3 has been tested. In the run state, the diameter Drun was 111.7 mm diameter, in the first set state the diameter Dsetmin was 155.7 mm, and in the second set state the diameter Dsetmax was 159.8 mm. The plug was tested in a pipe having a diameter in the narrow area of the abovementioned range, and also in a pipe having a diameter in the wider area of the range. The plug was able to hold a pressure of 5000 psi at 160° C., i.e. a considerable improvement of the 4000 psi pressure/110° C. temperature of the prior art HEX product.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

It should be mentioned that the invention described above could of course be used in well pipes having other diameters than the diameter(s) used in the above example.

The invention claimed is:

1. A sealing device for a well plug, comprising:

a mandrel device;

a sealing element provided circumferentially around the mandrel device;

a first supporting device provided on a first side of the sealing element;

a second supporting device provided on a second side of the sealing element, wherein each supporting device comprises proximal supporting elements provided proximal to the sealing element and distal supporting elements, where first ends of the respective proximal and distal supporting elements are pivotably connected to each other;

wherein second ends of the proximal supporting elements are pivotably connected to a first connector of a proximal supporting ring;

wherein second ends of the distal supporting elements are connected to a distal supporting ring;

wherein the sealing device is brought from a run state to a first set state by relative axial movement of the distal supporting rings towards each other and relative axial movement of the proximal supporting rings towards each other, the first set state being realized when each distal supporting ring makes direct contact with the corresponding proximal supporting ring or indirect contact via at least one intermediate member, wherein each of the distal supporting rings and the corresponding proximal supporting rings each at least partially contact the corresponding intermediate member; and wherein the first connector comprises an expansion section in the radial direction of the proximal supporting ring, the expansion section allowing the proximal supporting element to be displaced a radial distance from the first set state to a second set state.

2. The sealing device according to claim 1, wherein the first connector of the proximal supporting ring comprises a slit and a curved recess and where the expansion section is being provided as a radial expansion of the curved recess.

3. The sealing device according to claim 2, wherein the second end of the proximal supporting element comprises a spherical-like connector, where the spherical-like connector, the curved recess and the expansion section of the first connector are adapted to each other.

4. The sealing device according to claim 1, further comprising a first cone ring provided around the mandrel device axially between the first supporting device and the sealing element and a second cone ring provided around the mandrel device axially between the second supporting device and the sealing element, where the first and second cone rings each comprise an abutment surface in abutment with a front expansion surface of the respective proximal supporting elements in the first set state and in the second set state.

5. The sealing device according to claim 4, wherein the first abutment surface has a first angle in relation to the longitudinal direction of the sealing device and the second abutment surface has a second angle in relation to the longitudinal direction of 30-90°.

6. The sealing device according to claim 4, wherein each of the proximal supporting elements comprises a rear expansion surface provided on the opposite side of the front expansion surface, where the angle $\alpha_{exp}$ between the front and rear expansion surfaces is between 20-60°.

7. The sealing device according to claim 6, wherein the rear expansion surface is oriented perpendicular to the longitudinal axis of the distal supporting element.

8. The sealing device according to claim 1, wherein an axial compression force used for bringing the sealing device from the run state to the set state is transferred from the distal supporting rings to the proximal supporting rings.

9. A sealing device for a well plug, comprising:

a mandrel device;

a sealing element provided circumferentially around the mandrel device;

a first supporting device provided on a first side of the sealing element;

a second supporting device provided on a second side of the sealing element, wherein each supporting device comprises proximal supporting elements provided proximal to the sealing element and distal supporting elements, where first ends of the respective proximal and distal supporting elements are pivotably connected to each other;

wherein second ends of the proximal supporting elements are pivotably connected to a first connector of a proximal supporting ring;

wherein second ends of the distal supporting elements are connected to a distal supporting ring;

wherein the sealing device is brought from a run state to a first set state by relative axial movement of the distal supporting rings towards each other and relative axial movement of the proximal supporting rings towards each other; and wherein the first connector comprises an expansion section in the radial direction of the proximal supporting ring, the expansion section allowing the proximal supporting element to be displaced at a radial distance from the first set state to a second set state, the sealing device further comprising a delay mechanism for each supporting device, wherein the delay mechanism delays the radial expansion of the supporting devices in relation to the radial expansion of the sealing element when moving from the run state to the set state.

10. The sealing device according to claim 9, wherein the delay mechanism comprises an axially displaceable sealing element setting sleeve provided radially between the proximal supporting ring and the mandrel device, a shear pin connecting the proximal supporting ring to the axially displaceable sealing element setting sleeve in the run state.

* * * * *